US009882287B2

(12) United States Patent
Talty et al.

(10) Patent No.: US 9,882,287 B2
(45) Date of Patent: Jan. 30, 2018

(54) CO-LINEAR AM/FM AND DSRC ANTENNA

(71) Applicant: GM GLOBAL TECHNOLOGY OPERATIONS LLC, Detroit, MI (US)

(72) Inventors: Timothy J. Talty, Beverly Hills, MI (US); Donald K. Grimm, Utica, MI (US); Duane S. Carper, Davison, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 274 days.

(21) Appl. No.: 14/699,541

(22) Filed: Apr. 29, 2015

(65) Prior Publication Data

US 2015/0318605 A1 Nov. 5, 2015

Related U.S. Application Data

(60) Provisional application No. 61/987,729, filed on May 2, 2014.

(51) Int. Cl.
*H01Q 1/32* (2006.01)
*H01Q 21/28* (2006.01)
*H01Q 9/32* (2006.01)

(52) U.S. Cl.
CPC ..... *H01Q 21/28* (2013.01); *H01Q 1/3275* (2013.01); *H01Q 9/32* (2013.01)

(58) Field of Classification Search
CPC ..... H01Q 21/28; H01Q 1/3275; H01Q 9/32
USPC ..... 343/715, 711, 713
See application file for complete search history.

(56) References Cited

U.S. PATENT DOCUMENTS 5,311,201 A * 5/1994 Lillie ..... H01Q 5/321 343/715
2008/0198077 A1* 8/2008 Duzdar ..... H01Q 21/30 343/715
2012/0026047 A1* 2/2012 Ferrero ..... H01Q 1/3275 343/711
2013/0141297 A1* 6/2013 Gomme ..... H01Q 5/35 343/770
2013/0229315 A1* 9/2013 Duzdar ..... H01Q 1/3275 343/713
2014/0015717 A1* 1/2014 Kowalewicz ..... H01Q 1/3275 343/715
2015/0071137 A1* 3/2015 Thiam ..... H01Q 9/0407 370/297
2016/0104932 A1* 4/2016 Aminzadeh ..... H01Q 1/3275 343/872

FOREIGN PATENT DOCUMENTS

CN 203826544 * 4/2014

* cited by examiner

*Primary Examiner* — Dameon E Levi
*Assistant Examiner* — David Lotter
(74) *Attorney, Agent, or Firm* — John A. Miller; Miller IP Group, PLC

(57) ABSTRACT

An antenna assembly for a vehicle that includes an AM/FM mast antenna element for AM/FM signals and a WiFi or DSRC antenna element positioned at a tip of the mast, where the antenna assembly is mounted to a vehicle roof and where the WiFi or DSRC antenna element extends above a roof line of the vehicle.

16 Claims, 2 Drawing Sheets

CO-LINEAR AM/FM AND DSRC ANTENNA

CROSS-REFERENCE TO RELATED APPLICATIONS

This application claims the benefit of the priority date of U.S. Provisional Patent Application Ser. No. 61/987,729, titled, Co-Linear AM/FM and DSRC Antenna, filed May 2, 2014.

BACKGROUND OF THE INVENTION

Field of the Invention

This invention relates generally to a combined AM/FM and WiFi antenna assembly and, more particularly, to a combined AM/FM and dedicated short range communications (DSRC) system mast antenna assembly for a vehicle, where the mast antenna assembly is positioned on a vehicle roof and the DSRC system antenna is placed at a top end of the mast antenna assembly.

Discussion of the Related Art

Traffic accidents and roadway congestion can be significant problems for vehicle travel. Vehicular ad-hoc network based active safety and driver assistance systems are known that allow a vehicle communications system, such as a dedicated short range communications (DSRC) system, to transmit messages to other vehicles in a particular area with warning messages about dangerous road conditions, driving events, accidents, etc. In these systems, multi-hop geocast routing protocols, known to those skilled in the art, are commonly used to extend the reachability of the warning messages, i.e., to deliver active messages to vehicles that may be a few kilometers away from the road condition, as a one-time multi-hop transmission process. In other words, an initial message advising drivers of a potential hazardous road condition is transferred from vehicle to vehicle using the geocast routing protocol so that vehicles a significant distance away will receive the messages because one vehicle's transmission distance is typically relatively short.

Vehicle-to-vehicle (V2V) and vehicle-to-infrastructure (V2I), collectively known as V2X, communications systems of the type being described herein require a minimum of one entity to send information to another entity. For example, many vehicle-to-vehicle safety applications can be executed on one vehicle by simply receiving broadcast messages from a neighboring vehicle. These messages are not directed to any specific vehicle, but are meant to be shared with a vehicle population. In these types of applications, where collision avoidance is desirable, as two or more vehicles talk to each other and a collision becomes probable, the systems can warn the vehicle drivers, or possibly take evasive action for the driver, such as applying the brakes. Likewise, traffic control units can observe the broadcast of information and generate statistics on traffic flow through a given intersection or roadway.

Modern vehicles employ various and many types of antennas to receive and transmit signals for different communications systems, such as terrestrial radio (AM/FM), cellular telephone, satellite radio, DSRC, GPS, etc. Often the antennas used for these systems are mounted to a roof of the vehicle so as to provide maximum reception capability. Further, many of these antennas are often integrated into a common structure and housing mounted to the roof of the vehicle.

The design and style of a vehicle often requires that the vehicle roof have a curved configuration. It is known to mount the antenna for a DSRC system to the back part of the roof of the vehicle. In this configuration, the DSRC antenna may be at least partially blocked from a forward view because of a raised center portion of the vehicle roof, thus reducing antenna performance because there is more radiation from the antenna coming off the rear of the vehicle and less radiation coming off the front of the vehicle.

SUMMARY OF THE INVENTION

The present disclosure describes a mast antenna assembly for a vehicle that includes an AM/FM mast antenna for AM/FM signals and a WiFi antenna element, such as a DSRC antenna element, positioned at a tip of the mast antenna assembly, where the antenna assembly is mounted to a vehicle roof, and where the DSRC antenna element extends above a roof line of the vehicle.

Additional features of the present invention will become apparent from the following description and appended claims, taken in conjunction with the accompanying drawings.

DETAILED DESCRIPTION OF THE EMBODIMENTS

The following discussion of the embodiments of the invention directed to an antenna assembly including an AM/FM mast antenna and a WiFi antenna, such as a DSRC antenna, mounted to a tip of the mast is merely exemplary in nature, and is in no way intended to limit the invention or its applications or uses. For example, the discussion herein is specific to a vehicle antenna assembly. However, the antenna assembly may have application for other mobile platforms.

Figure 1:
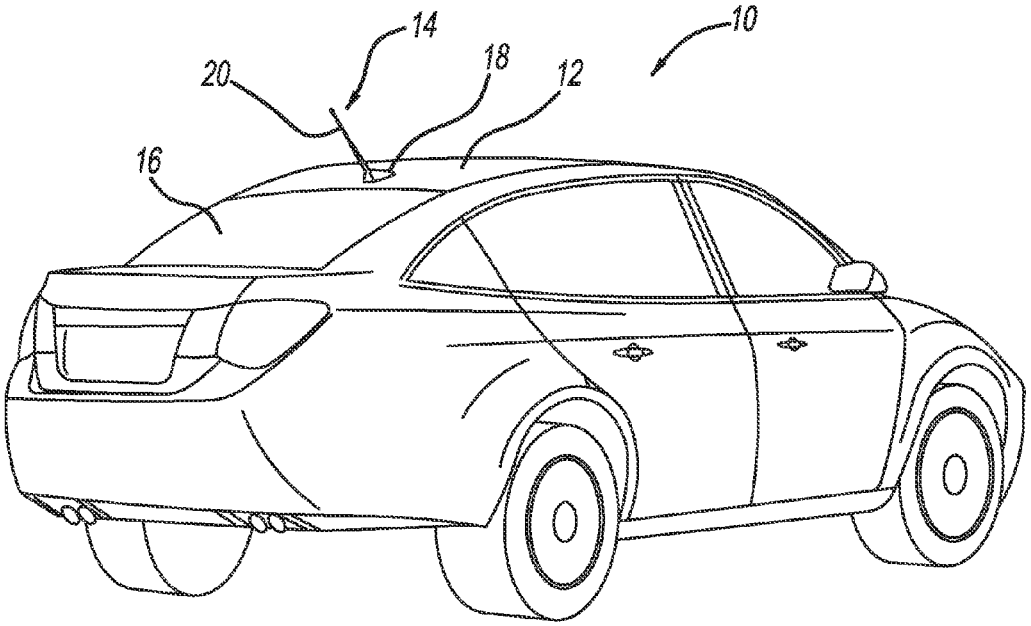
FIG - 1 Prior Art
FIG. 1 is an isometric rear view of a vehicle including a known antenna assembly having an AM/FM mast antenna.

FIG. 1 is rear isometric view of a vehicle 10 including a curved vehicle roof 12, where a front and rear portion of the roof 12 are lower than a middle portion of the roof 12. An antenna assembly 14 is mounted to the rear portion of the roof 12 just above a rear window 16 of the vehicle 10. The antenna assembly 14 includes a base portion 18 and a mast 20. For some of the known antenna designs having this configuration, the mast 20 typically includes a radiating antenna element for AM/FM radio reception and the base portion 18 may house one or more other antenna elements that support cellular telephone, satellite radio, GPS, DSRC, etc. The mast 20 extends above the roof 12 of the vehicle 10 and as such has a good line of sight to the front of the vehicle 10 over the curvature of the roof 12. However, the base portion 18 is mounted in close proximity to the roof 12 and as such may be below the highest part of the roof 12 possibly causing blockage of antenna radiation towards the front of the vehicle 10. For those antenna elements whose antenna pattern for transmission and reception is directed upwards, such as satellite radio and GPS, the curvature of the roof 12 may not present a performance issue. Further, for those terrestrial based applications, such as cellular telephone, that may operate at a relatively low frequency, the curvature of the roof 12 has less impact on blocking the antenna radiation pattern. However, for those antennas, such as WiFi and DSRC antennas, that are communicating with other vehicles on the same roadway and infrastructure along the roadway at a relatively high frequency, such as 5.9 GHz used for V2X communications systems, the curved vehicle roof 12 could reduce the radiating affect of the antenna in a forward direction of the vehicle 10, which could present performance issues. It is noted that the DSRC protocol is also known as IEEE 802.11p, which is part of the IEEE 802.11 "WiFi" wireless protocols. While the present invention is discussed herein as specifically employing the DSRC (IEEE 802.11p) protocol, the invention is not limited to that specific wireless protocol and does have application for other IEEE 802.11 WiFi protocols.

Figure 2:
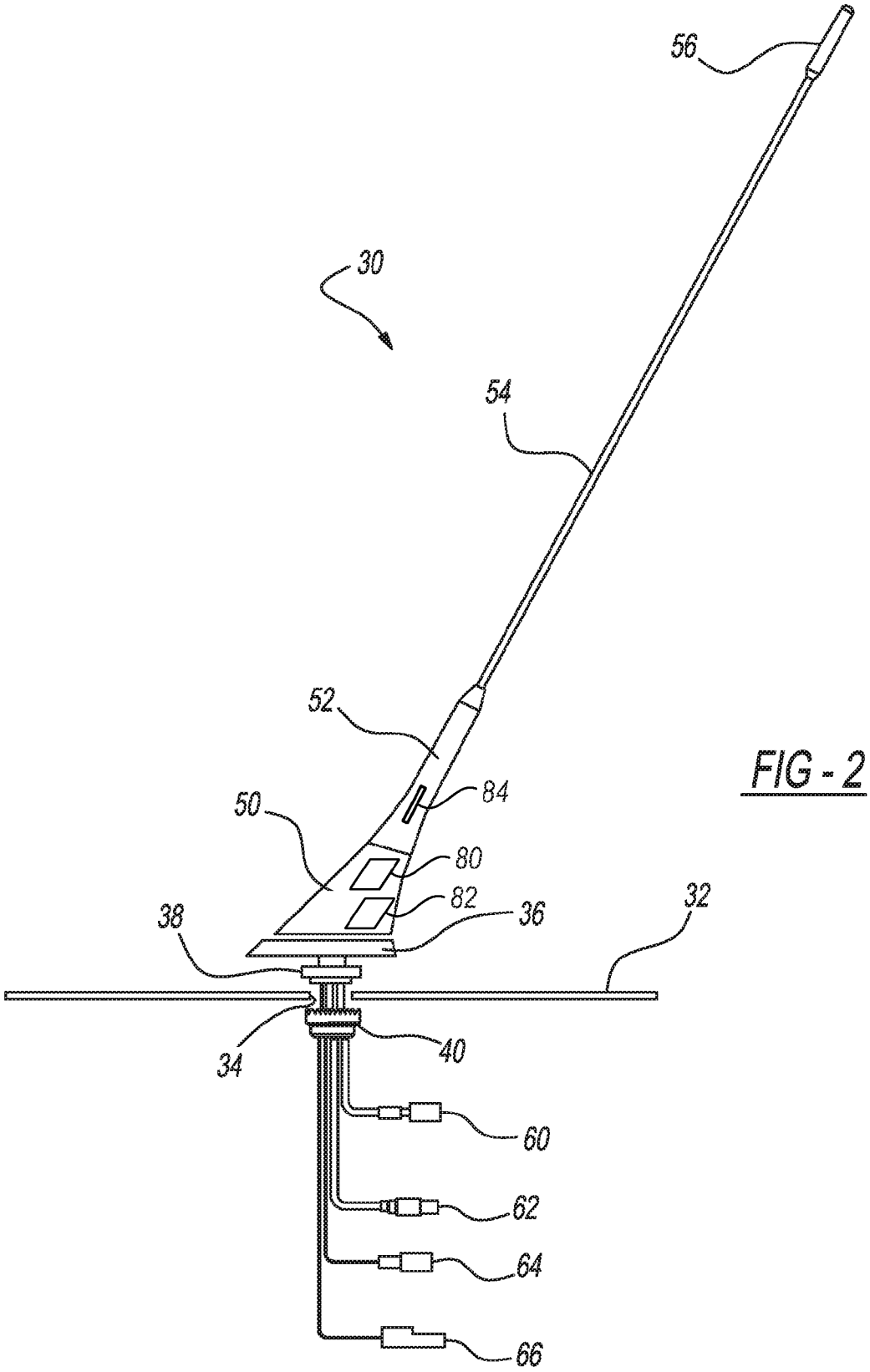
FIG. 2 is a side profile view of an antenna assembly mounted to a vehicle roof including an AM/FM mast antenna and a DSRC antenna element positioned at the tip of the mast.

FIG. 2 is a side view of an antenna assembly 30 mounted to a roof panel 32 of a vehicle, where the antenna assembly 30 is angled backward relative to the forward direction of the vehicle at a certain angle, such as 70°. The antenna assembly 30 is mounted within an opening 34 in the roof panel 32 using, for example, a gasket 36, an O-ring or washer 38 positioned outside of the roof panel 32, and a clamp nut 40 positioned within the roof panel 32 of the vehicle, as shown. The antenna assembly 30 includes a base portion 50 mounted adjacent to the gasket 36 and a wide mast portion 52 mounted to the base portion 50 opposite to the gasket 36, as shown. A narrow mast portion 54 is mounted to the wide mast portion 52 opposite to the base portion 50 and a tip portion 56 is mounted to the narrow mast portion 54 opposite to the wide mast portion 52.

The antenna assembly 30 includes a number of antenna elements appropriately configured and positioned to receive and transmit signals of the desired wavelength for the particular application. For example, the base portion 50 houses one or more radiating antenna elements, represented as 80 and 82, for any combination of cellular telephone antenna elements, GPS antenna elements, satellite radio antenna elements, etc., which all may be, for example, patch type antenna elements that support the particular frequency band for the application. In one non-limiting embodiment, the wide mast portion 52 houses a digital audio broadcast (DAB) antenna element of a suitable length for DAB signals, such as may be employed in Europe. The narrow mast portion 54 encloses a mast antenna element, such as a monopole or dipole antenna, of a suitable length for AM and/or FM terrestrial radio broadcasts. The tip portion 56 houses a WiFi antenna element, such as a DSRC antenna element, and as such extends high enough above the roof panel 32 so that for reasonably curved vehicle roofs, the DSRC antenna element is visible from the front of the vehicle. In an alternate embodiment, the DAB antenna element can be placed on top of the AM/FM antenna element so that it is adjacent to the DSRC antenna element.

It is noted that the antenna assembly of the present invention is discussed herein as being mounted to the vehicle roof. However, mast antennas are sometimes mounted to other vehicle structures, such as vehicle bumpers. The present invention will have application for other types of mast antennas mounted to various vehicle structures, where the DSRC antenna is mounted within the wide mast portion 52 or the narrow mast portion 54.

The antenna elements are suitably packaged and configured within the antenna assembly 30 and the outer housings for the particular application. Each antenna element would be electrically coupled to a proper conductor so that signals for transmission are provided to the particular antenna element and signals that are received by the particular antenna element are transferred to the receiver (not shown). For example, a connector assembly 60 is provided for the DAB antenna element, a connector assembly 62 is provided for the AM/FM antenna element, and a connector assembly 64 is provided for the DSRC antenna element. Although not specifically shown, connections for any or all of the cellular telephone antenna element, GPS antenna element and satellite radio antenna element would also be provided. A connector 66 is also employed to provide a voltage potential to a low noise amplifiers (LNA) (not shown), for example, for the AM/FM antenna element. Additional coaxial cables and/or wires may also be provided for other wireless services, such as GPS and/or SiriusXM™ satellite radio.

It is known in the art that various DSRC and WiFi technologies implement multiple antennas. Such antennas can support additional radios or provide redundant diversity capabilities for a single radio. In addition to the antennas discussed above, the antenna assembly 30 can also support a secondary or diversity antenna element 84 for these purposes. The diversity or secondary DSRC/WiFi antenna element 84 can be located in any of the base portion 50, the wide mast portion 52 and the narrow mast portion 54. A separate coaxial cable (not shown) can be provided from the diversity or secondary antenna element to the separate radio or to a secondary or diversity antenna input of the DSRC radio. The secondary input to the DSRC radio could also be used for a non-safety channel of the DSRC system while the primary antenna element is dedicated to a safety only channel of the DSRC system.

The diversity or secondary antenna element for the DSRC radio can also be used in a transmit mode where the secondary antenna element is used to fill in radiation gaps that may exist due to primary antenna element radiation limitations. The combination of the two antenna elements enables the DSRC system to optimize radiated power levels while meeting all performance requirements.

Figure 3:
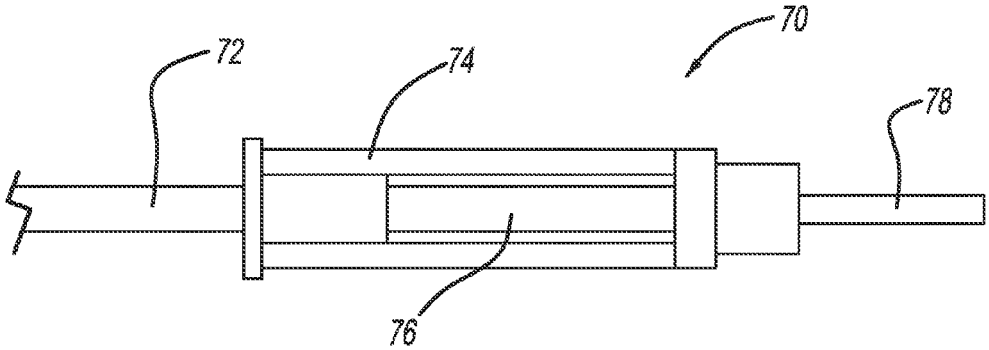
FIG. 3 is a side view of a DSRC antenna element separated from the antenna assembly shown in FIG. 2.

The WiFi or primary and secondary DSRC antenna elements can be any suitable antenna element for the purposes discussed herein, such as an antenna element that operates at 5.9 GHz for a V2X communications system. FIG. 3 is a side view of a coaxial sleeve antenna 70 suitable for a DSRC antenna element, where the antenna 70 would be mounted within the tip portion 56. The antenna 70 includes a coax cable 72 mounted to an antenna base support 74, where the cable 72 includes an outer conductor 76 and an inner conductor 78 extending from the support 74, as shown. The length of the inner conductor 78 extending from the support 74 forms the radiating element of the antenna 70 and is set to the desired length for the particular frequency band of interest.

As will be well understood by those skilled in the art, the several and various steps and processes discussed herein to describe the invention may be referring to operations performed by a computer, a processor or other electronic calculating device that manipulate and/or transform data using electrical phenomenon. Those computers and electronic devices may employ various volatile and/or non-volatile memories including non-transitory computer-readable medium with an executable program stored thereon including various code or executable instructions able to be performed by the computer or processor, where the memory and/or computer-readable medium may include all forms and types of memory and other computer-readable media.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna assembly operable to be mounted to a structure, said antenna assembly comprising:

a base portion configured to be mounted adjacent to the structure, said base portion including a plurality of antenna elements, said plurality of antenna elements including one or more of a cellular telephone antenna element, a satellite radio antenna element and a GPS antenna element;

a mast including a lower end mounted to the base portion and an upper end opposite to the base portion, said mast including at least an AM/FM antenna element, where the AM/FM antenna element receives AM and FM radio signals, wherein the mast includes a first mast portion and a second mast portion, where the first mast portion includes the AM/FM antenna element and the second mast portion includes a digital audio broadcast (DAB) antenna element; and a tip portion coupled to the mast opposite to the base portion, said tip portion including a primary WiFi antenna element.

2. The antenna assembly according to claim 1 wherein the primary WiFi antenna element is a dedicated short range communications (DSRC) system antenna element.

3. The antenna assembly according to claim 1 wherein the primary WiFi antenna element is an IEEE 802.11 protocol antenna element.

4. The antenna assembly according to claim 3 wherein the primary WiFi antenna element is an IEEE 802.11p protocol antenna element.

5. The antenna assembly according to claim 1 wherein the primary WiFi antenna element is a coaxial sleeve antenna element.

6. The antenna assembly according to claim 1 further comprising a secondary WiFi antenna element.

7. The antenna assembly according to claim 6 wherein the secondary WiFi antenna element is a diversity antenna element.

8. The antenna assembly according to claim 6 wherein the secondary WiFi antenna element is provided in the base portion or the mast.

9. The antenna assembly according to claim 1 wherein the first mast portion is coupled to the base portion, the second mast portion is coupled to the first mast portion and the tip portion is coupled to the second mast portion.

10. The antenna assembly according to claim 1 wherein the second mast portion is coupled to the base portion, the first mast portion is coupled to the second mast portion and the tip portion is coupled to the first mast portion.

11. The antenna assembly according to claim 1 wherein the structure is a vehicle structure.

12. The antenna assembly according to claim 11 wherein the structure is a vehicle roof panel.

13. The antenna assembly according to claim 12 wherein the antenna assembly is angled relative to the roof panel.

14. An antenna assembly operable to be mounted to a roof panel of a vehicle, said antenna assembly comprising:

a base portion configured to be mounted adjacent to the roof panel, wherein the base portion includes a plurality of antenna elements, said plurality of antenna elements including one or more of a cellular telephone antenna element, a satellite radio antenna element, a GPS antenna element and a diversity antenna element;

a mast including a lower end mounted to the base portion and an upper end opposite to the base portion, said mast including at least an AM and FM antenna element; and a tip portion coupled to the mast opposite to the base portion, said tip portion including a dedicated short range communications (DSRC) system antenna element.

15. An antenna assembly comprising:

a base portion configured to be mounted adjacent to a roof panel, said base portion including a plurality of antenna elements, said plurality of antenna elements including one or more of a cellular telephone antenna element, a satellite radio antenna element and a GPS antenna element;

a mast including a lower end mounted to the base portion and an upper end opposite to the base portion, said mast including a first mast portion having an AM and FM antenna element and a second mast portion having a digital audio broadcast (DAB) antenna element; and a tip portion coupled to the mast opposite to the base portion, said tip portion including a primary dedicated short range communications (DSRC) system antenna element.

16. The antenna assembly according to claim 15 further comprising a secondary or diversity antenna element.

* * * * *